United States Patent [19]

Ide

[11] Patent Number: 4,610,446

[45] Date of Patent: Sep. 9, 1986

[54] SHEET MATERIAL TRANSPORTING APPARATUS

[75] Inventor: Fumitō Ide, Zama, Japan

[73] Assignee: Kabushiki Kaisha Toshiba, Kawasaki, Japan

[21] Appl. No.: 685,782

[22] Filed: Dec. 24, 1984

[30] Foreign Application Priority Data

Dec. 27, 1983 [JP] Japan ..... 58-246397

[51] Int. Cl.[4] ..... B65H 29/00

[52] U.S. Cl. ..... 271/291; 271/65; 271/186; 271/902

[58] Field of Search ..... 271/291, 301, 186, 902, 271/259, 65

[56] References Cited

U.S. PATENT DOCUMENTS 4,365,794 12/1982 Roller ..... 271/291 X
4,456,236 6/1984 Buddendeck ..... 271/291 X
4,487,506 12/1984 Repp ..... 271/145 X

OTHER PUBLICATIONS

IBM Technical Disclosure Bulletin, vol. 14, No. 5, p. 1453, Oct. 1971, "Duplex Copier Incorporating Sorter-Collator", G. I. Simpson, Jr.

*Primary Examiner*—Richard A. Schacher
*Attorney, Agent, or Firm*—Cushman, Darby & Cushman

[57] ABSTRACT

A sheet material transporting apparatus has a first convey portion for conveying a sheet having an image on one surface thereof in a first direction along a first convey path, the image being formed by an image-forming section, and a second convey portion for conveying the sheet in a second direction along a second convey path extending to the image-forming section through the first convey path so as to form an image on the other surface of the sheet. A trailing edge detector is arranged in the vicinity of a branched portion between the first and second convey path to detect the trailing edge of the sheet. In a sheet guide portion for causing the branched portion between the first and second convey paths to communicate with the discharge portion, the sheet is sent in a first direction for a predetermined period of time after the trailing edge of the sheet is detected by the trailing edge detector to invert the sheet conveying direction to the second convey path.

5 Claims, 13 Drawing Figures

SHEET MATERIAL TRANSPORTING APPARATUS

BACKGROUND OF THE INVENTION

The present invention relates to a sheet material transporting apparatus and, more particularly, to a sheet material transporting apparatus used in an image-forming apparatus such as a copying machine.

In a conventional two-side copying machine wherein the images are respectively formed on the front and back surfaces of a sheet, after a toner image is transferred to and fixed on one surface of the sheet, the sheet is discharged by the sheet material transporting apparatus from a fixing unit. The sheet is then fed to a sheet feed direction changing gate which changes the feed direction of the sheet in order to turn over the sheet. This inverted sheet is again fed by the sheet material transporting apparatus to a transfer portion. Another toner image is formed on the other surface of the sheet. This toner image is fixed by the fixing unit, thereby completing two-side copying. According to the conventional copying machine of this type, the gate for changing the feed direction of the sheet must be arranged in the sheet material transporting apparatus, thus increasing the number of components and the space required for the gate.

SUMMARY OF THE INVENTION

It is an object of the present invention to provide a sheet material transporting apparatus which has a small number of components and does not require extra space.

According to an aspect of the present invention, there is provided a sheet material transporting apparatus comprising a first convey path for conveying a sheet having an image on one surface thereof along a first direction, a second convey path for conveying the sheet along a second direction leading to an image forming section to form an image on the other surface thereof, a sheet trailing edge detector arranged in the vicinity of a branch point between the first convey path and the second convey path, and means for conveying the sheet along the first direction for a predetermined period of time upon detection of the trailing edge of the sheet and changing the transportion direction of the sheet to the second convey path.

DETAILED DESCRIPTION OF THE PREFERRED EMBODIMENT

Figure 1:
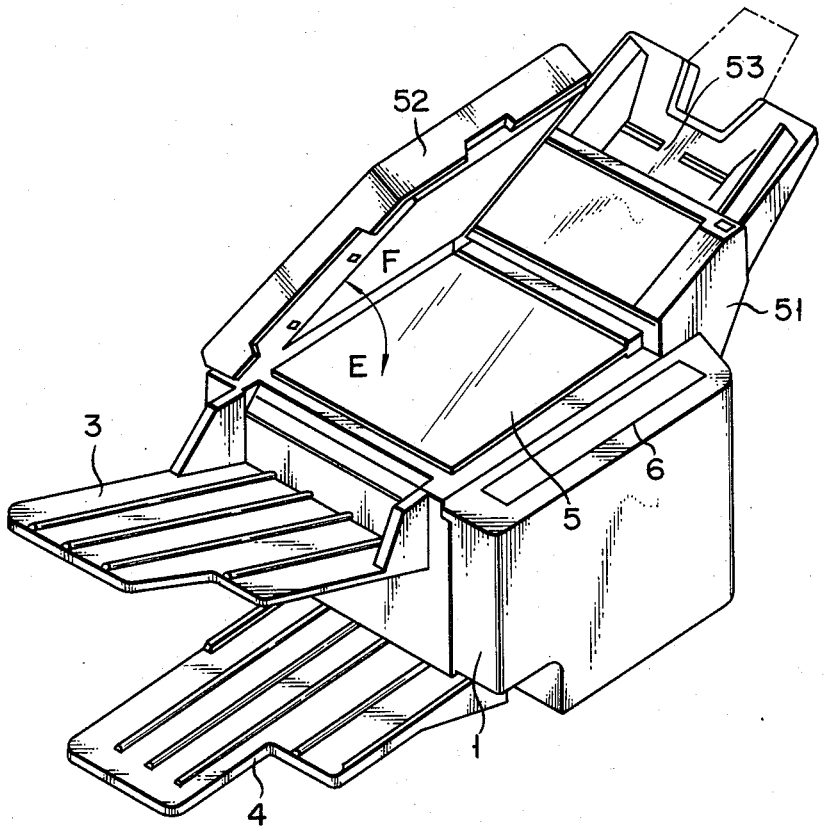
FIG. 1 is a perspective view of a copying machine using a sheet material transporting apparatus according to an embodiment of the present invention.

FIG. 1 shows a copying machine having a sheet material transporting apparatus according to the present invention. A document feeder for feeding a document is arranged at the upper portion of a copying machine housing 1. A document tray 3 is attached to the left side of the housing 1. A discharge tray 4 is attached to the left side of the housing 1 below the document tray 3. A document table (transparent glass plate) 5 is mounted on the upper surface of the housing 1 and a document D is placed thereon. An operation panel 6 is disposed on the upper front portion of the housing 1.

An exposure system 15 is disposed under the document table 5. The exposure system 15 comprises an exposure lamp 7 which moves reciprocally, mirrors 8, 9 and 10, a lens block 11 which can be moved along the optical axis, and fixed mirrors 12, 13 and 14. The document image is scanned by the exposure system 15 and is formed (i.e., slit exposure) on a photoconductive layer of a photoconductive drum 16. The photoconductive drum 16 is rotated in the direction of the arrow. The surface of the photoconductive drum is charged by a charger 17, and the document image is slit-exposed, thereby forming a latent image on the surface of the photosensitive layer. A developing unit 18 develops the latent image to obtain a toner or visible image.

Sheets P are picked up one by one from a paper cassette 19 by a paper feed roller 20. The fed sheet is guided to register rollers 22 through a paper guide path 21. The sheet is then guided by the register rollers 22 to a transfer portion. The paper cassette 19 is detachably mounted on the lower portion of the housing 1.

The sheet P fed in the transfer portion is brought into tight contact with a surface portion of the photoconductive drum 16 which corresponds to a charger 23. The toner image is transferred from the photoconductive drum 16 to the sheet P by the charger 23. The sheet P is then electrostatically separated from the photoconductive drum 16 by a separating charger 24. The separated sheet P is conveyed by a conveyor belt 25 along a sheet convey path 26 and reaches heat rollers 27 which serve as a fusing unit and are disposed on the termination section of the convey path 26. When the sheet P passes between the heat rollers 27, the toner image on the sheet P is fused. The sheet discharged by discharge rollers 28 after the toner image is fused is guided to discharge rollers 30 along a convey path 29. In the normal copy mode, the sheet P is discharged by the discharge rollers 30 outside the housing 1 and is guided to a tray 4. Meanwhile, residual toner on the surface of the photoconductive drum 16 is removed by a cleaner 31, and the after image on the photoconductive drum 16 is removed by a discharge lamp 32. The photoconductive drum 16 is then restored to the initial state.

When the two-side copy mode is set, the sheet P guided to the discharge rollers 30 is switched back and guided to a V-shaped convey path 34 constituted by a guide 33 which extends below the fusing unit. The sheet P conveyed along the convey path 34 is fed by a feed roller 35 and is thereafter clamped between conveyor belts 36 and 37 disposed on the bottom portion of the housing 1. The sheet p is inverted by an inversion path 38, and the inverted sheet P is fed to the register rollers 22. The convey path 34, the feed roller 35, the conveyor belts 36 and 37 and the inversion path 38 constitute an inversion convey unit 39.

A manual feed port 40 is formed above the paper cassette 19 in order to feed the sheet P in the manual mode. The sheet P supplied through the manual feed port 40 is fed to the register rollers 22 by conveyor rollers $41_1$ and $42_2$.

A detection switch 42 is arranged just in front of the register rollers 22 to detect the leading end of the sheet P. A detection switch 43 is arranged immediately behind the discharge rollers 28 to detect the passing of the sheet P therebetween. A detection switch 44 is arranged just in front of the discharge rollers 30 to detect that the leading end of the sheet P has reached the discharge rollers 30.

Figure 2:
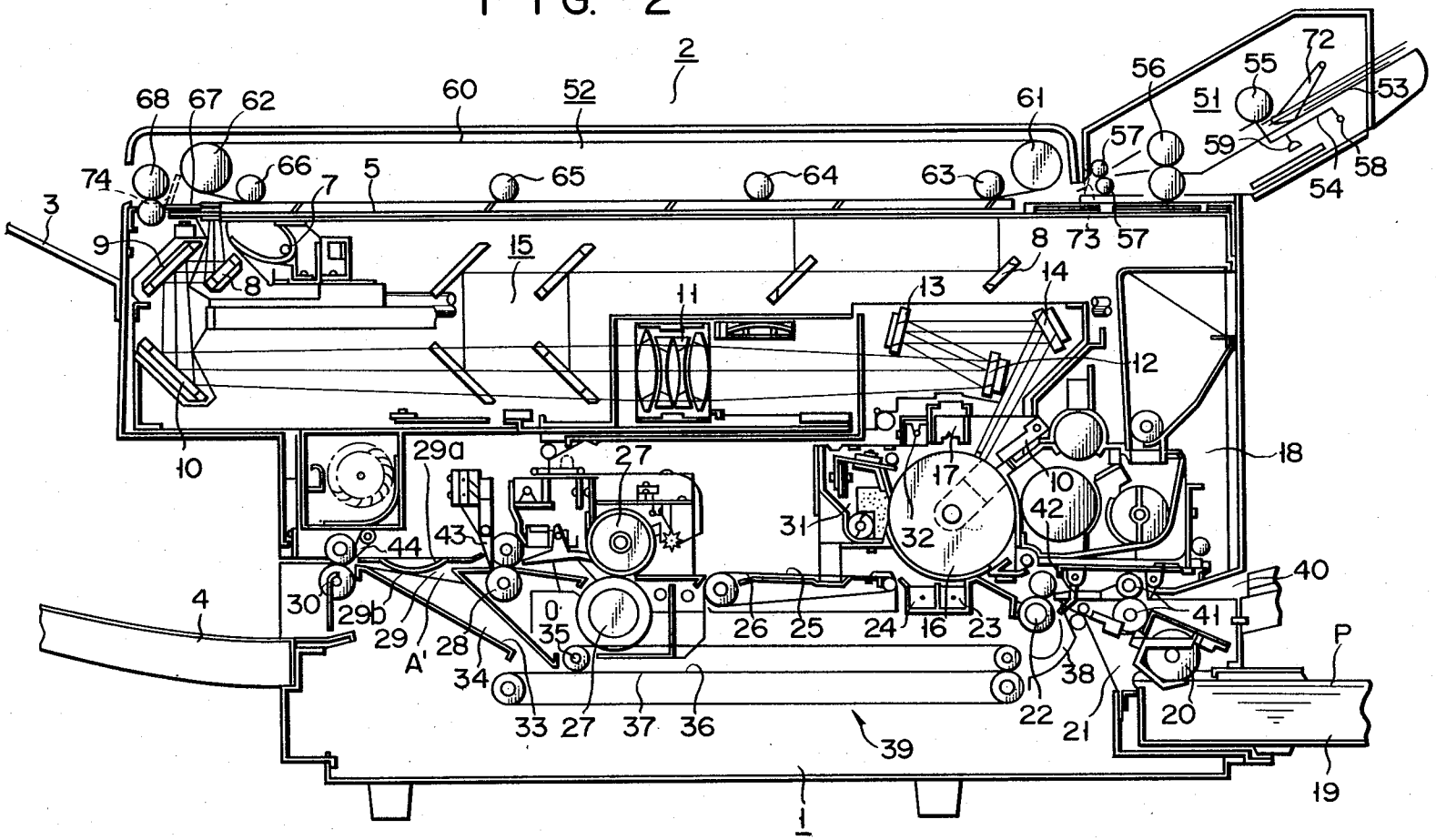
FIG. 2 is a sectional view showing the internal construction of the copying machine in FIG. 1.
Figure 3:
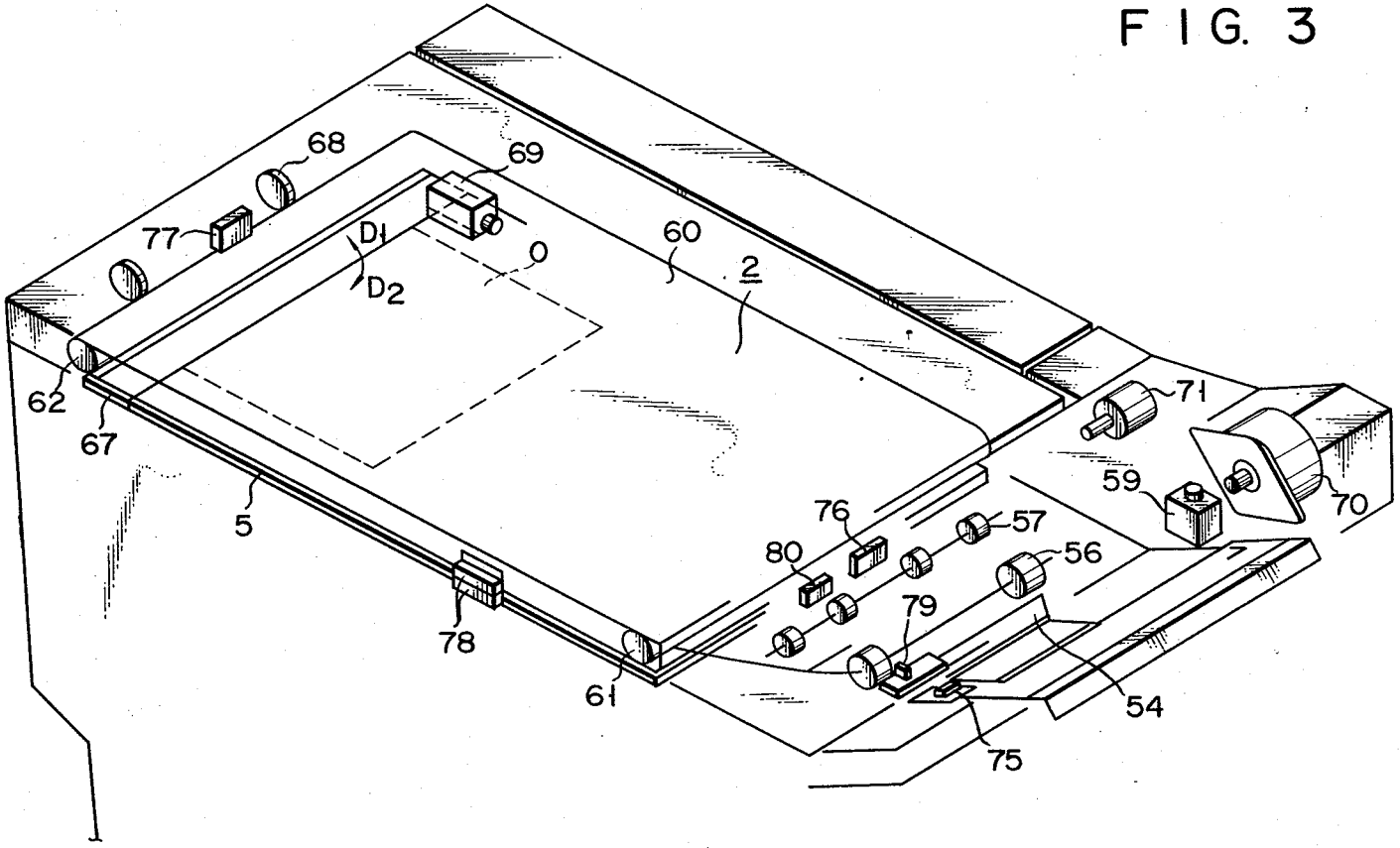
FIG. 3 is a perspective view showing the schematic construction of a document feeder.

As shown in FIGS. 2 and 3, a document feeder 2 comprises a document pickup portion 51 and a document convey portion 52. The document pickup portion 51 comprises a tray 53 for supporting the documents D, a stopper 54 for temporarily stopping the documents D placed on the tray 53, a document feed roller 55, supply rollers 56 and register rollers 57. The tray 53 is inclined at an angle of about 30 degrees such that the document D thereon can drop by its own weight to the position of the supply rollers 56. The stopper 54 can rock about a shaft 58 in the direction of the arrow so as to stop/-release the documents D placed on the tray 53. When the documents D are stopped by the stopper 54, the stopper 54 extends upward to stop the leading ends of the documents D. However, when the stopper 54 is moved downward by a solenoid 59, the documents 54 are released from the stopper 54. After the stopper 54 releases the documents D, the stopper 54 swings periodically in order to vibrate the documents D from the bottom, so that the documents D can be easily supplied. The document feed roller 55 is rotated in the direction of the arrow and is moved vertically in synchronism with the stop/release operation of the stopper 54. When the stopper 54 is withdrawn below the tray 53, the document feed roller 55 is moved downward. In this case, the roller 55 is brought into rolling contact with the uppermost document D and feeds this document forward. The document supply rollers 56 are rotated in opposing directions to transfer each document D to the direction of the document convey portion 52. The register rollers 57 feed to the document convey portion 52, the document D supplied from the supply rollers 56 at predetermined intervals. The register rollers 57 also correct the skew of the document D.

The convey portion 52 comprises an endless belt 60 as a document conveying means, rollers 61 and 62 around which the endless belt 60 is looped, rollers 63, 64, 65 and 66 for urging the belt 60 against the document table 5, a stopper 67 as a document stopping means for temporarily stopping the document D supplied from the document table 5, and discharge rollers 68. The stopper 67 can rock about a shaft (not shown) in directions indicated by arrows D1 and D2. The stopper 67 normally stops the leading edge of the document D in a position illustrated in FIG. 2. However, when the stopper 67 is moved downward by a solenoid 69, the leading edge of the document D is released. The supply rollers 56 are driven by a motor 70, and the register rollers 57, the rollers 61 and 62 and the discharge rollers 68 are driven by a motor 71.

A plurality of detection levers 72, 73 and 74 and microswitches 75, 76 and 77 which are interlocked with the levers 72, 73 and 74 are disposed in the document feeder 2. The detection lever 72 detects whether or not the documents D are placed on the tray 53. The detection lever 73 detects whether or not the document D is properly fed in the convey portion 52. The detection lever 74 detects whether or not the document D is discharged. The document feeder 2 also has a detector 78 for detecting opening/closing of the convey portion 52, a display 79 for displaying that the document D is set on the document tray 53, and a detector 80 for detecting whether or not a cover (not shown) of the document pickup portion 51 is opened.

The operation of the document feeder 2 having the construction described above will be described hereinafter. The documents D are placed on the tray 53 all at once. When the operator depresses a start switch to start copying, the solenoid 69 is energized to withdraw the stopper 67 below the document table 5. At the same time, the belt 60 starts running, so that any documents which might be left on the document table 5 are discharged. Simultaneously, the solenoid 59 is energized to move the stopper 54 toward the tray 53. While the document D on the tray 53 is fed toward the supply rollers 56 and is picked up by the rollers 56, the register rollers 57 are temporarily stopped. The document D is fed by the rollers 56 to the register rollers 57. The register rollers 57 correct the position of the document if it is skewed. The register rollers 57 start to rotate when the rollers 56 are stopped, so that the document D is fed to the convey portion 52.

The document D fed in the convey portion 52 is conveyed by the belt 60 toward the stopper 67. When the document D is conveyed to a position immediately in front of the stopper 67, the stopper 67 is moved upward and is placed in a stop position. In this state, the document D is stopped at a predetermined position. The belt 60 is continuously driven for a predetermined period of time after the leading edge of the document D abuts against the stopper 67, thereby aligning the document D. In this manner, the document D to be copied is fed to the document table and is copied. When copying is completed, the solenoid 69 is energized to withdraw the stopper 67 downward from the convey path. At the same time, the belt 60 is started so as to discharge the document D from the document table 5. The document D is discharged by the discharge rollers 68. When the detection lever 72 detects the next document D, copying is repeated. After copying, when the document D is detected by the detection lever 74, the stopper 67 is moved upward and is held in the stop position.

Figure 4:
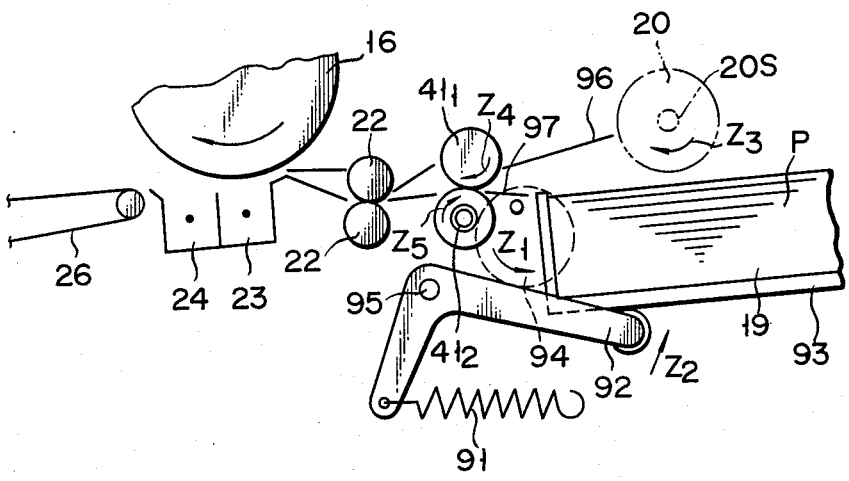
FIG. 4 is a sectional view of a sheet feed unit.

The construction of the paper feed unit constituted by the paper cassette 19 will be described in detail with reference to FIG. 4. The sheets P in the paper cassette 19 are supported on a bottom plate 93 which is normally urged upward by an arm 92. This arm is normally biased counterclockwise by a spring 91. By urging the bottom plate 93 upward, the uppermost sheet P is brought into tight contact with the paper feed roller 20. The arm 92 is supported by a shaft 95. A cam 94 abuts against the arm 92 to control rotation of the arm 92 caused by the biasing force of the spring 91. A shaft 20S of the paper feed roller 20 provides the rotational force to the cam 94 and serves as a transmission shaft for holding the cam 94. The sheet P taken up by the roller 20 is guided to the convey rollers $41_1$ and $41_2$along guides 96 and 97. The roller $4_{11}$ is rotated in the direction of the arrow, and the roller $41_2$ is brought into tight contact with the roller $41_1$ at a predetermined pressure and is rotated in a direction opposite to that of the roller $41_1$. The continuously supplied sheets P are separated by the rollers $41_1$ and $41_2$. Each sheet is guided by the rollers $41_1$ and $41_2$ to the register rollers 22.

The pickup operation of the sheet P in the paper feed unit having the construction described above will be described hereinafter. For example, a paper detecting means (not shown) is started, and a paper feed command is generated from a control unit (not shown). The transmission shaft 20S is rotated to rotate the cam 94 in the direction indicated by arrow Z1. The arm 92 rocks in the Z2 direction by the biasing force of the spring 91 upon pivotal movement of the cam 94. The cam 94 is rotated by half a revolution and is stopped. The uppermost sheet P is brought into tight contact with the outer surface of the roller 20. When rotation of the cam 94 is stopped, the roller 20 rotated together with the shaft 20S in the Z3 direction supplies a single sheet or a plurality of sheets P toward a contact portion between the rollers $41_1$ and $41_2$. When the leading edge of the sheet is clamped between the rollers $41_1$ and $41_2$, the roller $41_1$ stops rotating. Thereafter, the roller $41_1$ is rotated in the feed direction (the Z4 direction). At the same time, the roller $41_2$ is rotated in the feed-back direction (the Z5 direction). A return force within a given range is transmitted to the roller $41_1$. Only one sheet P is fed to the register rollers 22 in synchronism with the operation of the rollers $41_1$ and $41_2$ and is separated from other sheets. When the sheet P has reached the register rollers 22, the rollers $41_1$ and $41_2$are stopped. The sheets P which are not fed drop along the inclined surface of the lower guide 97. The pair of register rollers 22 feeds the sheet P to the photoconductive drum 16 in synchronism with the position of the document image formed on the photoconductive drum 16. In this case, the rollers $41_1$ and $41_2$ are rotated by force of the tension of the sheet P.

When a command representing continuous feeding of two successive sheets is generated from a control unit (not shown), the following operation succeding the above operation is performed. When the sheet P corresponding to the first document D is moved by a length L from a position where the trailing edge of the sheet P is separated from the roller 20 and to a contact portion between the rollers $41_1$ and $41_2$, the roller 20 is rotated in the Z3 direction and feeds the sheet P which is in contact therewith and which corresponds to the second document D. At the same time, the rollers $41_1$ and $41_2$ are rotated again, so that this sheet is conveyed while the first sheet P is pulled by the convey force of the register rollers 22 and is at the same time pushed by the rollers $41_1$ and $41_2$. When the leading edge of the second sheet P has reached the contact portion between the rollers $41_1$ and $41_2$, a distance between the leading edge of the previous sheet P and the contact portion between the rollers $41_1$ and $41_2$ is given as L'. It takes a period corresponding to L'/V for the previous sheet P to completely pass through the rollers $41_1$ and $41_2$ when the feed speed is given as V. Therefore, the next sheet p is fed after an interval corresponding to L'/V. The second sheet P is waved and waits immediately in front of the rollers $41_1$ and $41_2$ by the action of the roller $41_2$. Since the register rollers 22 and the roller $41_1$ are continuously rotated along the pickup direction, the next sheet P is fed out following the previous sheet P, so that continuous feeding of two successive sheets can be performed.

Figure 5:
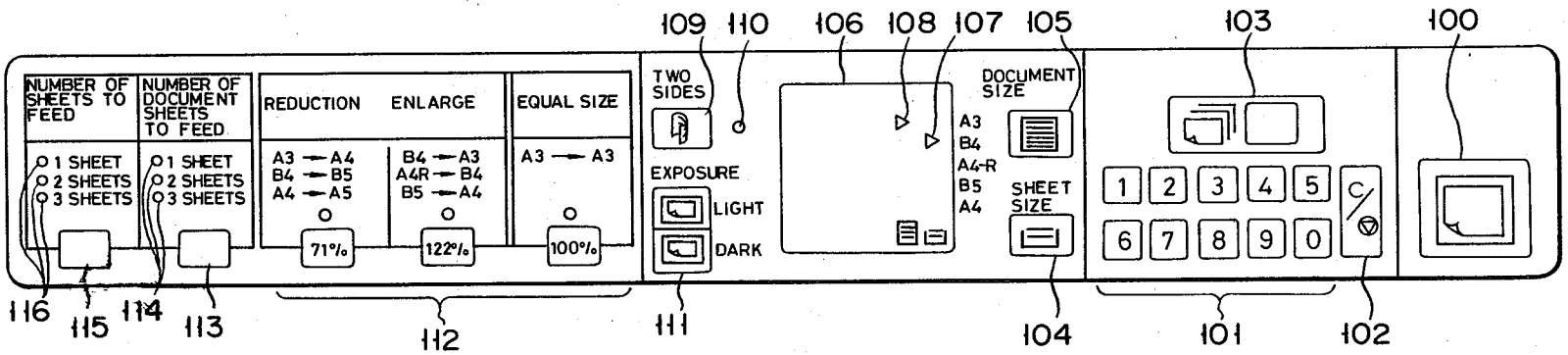
FIG. 5 is a plan view of an operation panel.

The operation panel 6 has the arrangement shown in FIG. 5. A copy key 100 is depressed to give a copy start command. Numeric keys 101 are used to enter a preset copy number. A key 102 serves as a clear/stop key. A sheet number display 103 displays a sheet number or the like. A paper size selection key 104 is used to set a desired paper size. A document size input key 105 is used to input a document size. A display 106, such as a liquid crystal display, displays a selected paper size, an input document size or jamming. A segment 107 in the display 106 indicates the paper size, and a segment 108 indicates a document size. A copy mode selection key 109 selects the single side or the two-side copy mode. An indicator 110 including of an LED or the like is turned on when the two-side mode is selected by the mode selection key 109 but is turned off when the single side copy mode is set. A density selection key 111 is used to set a desired density of a copy. Magnification keys 112 are selectively used to set a desired magnification factor. A document feed number selection key 113 is used to set the number of sheets to be placed on the document table 5. Indicators 114 respectively indicate document sheet numbers when they are turned on. A sheet feed number selection key 115 is used to select the number of sheets to be continuously fed. When a given number of sheets is selected by the selection key 115, the corresponding indicator 116 is turned on.

Figure 6:
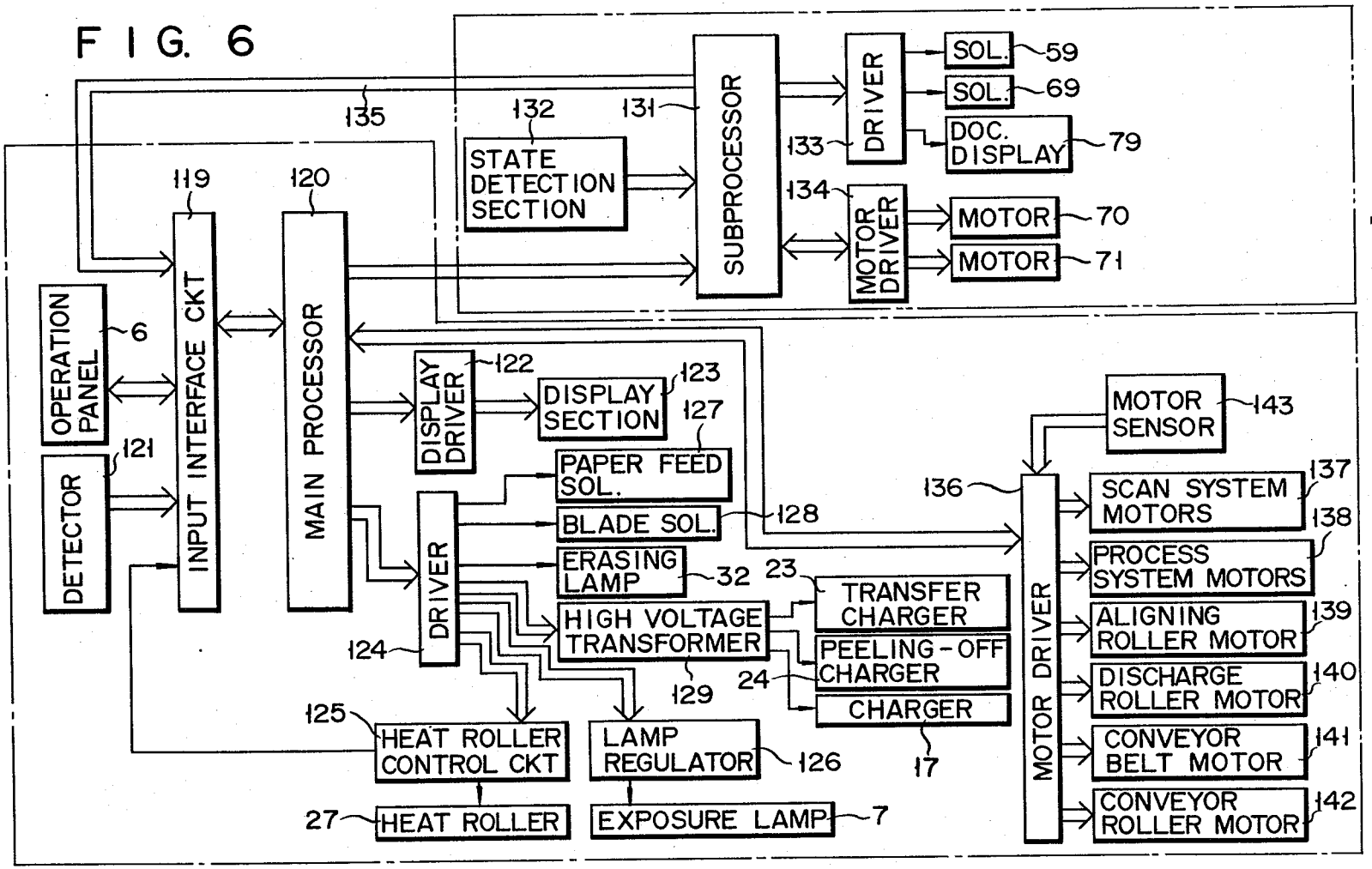
FIG. 6 is a block diagram of the copying machine.

A controlling means for controlling the operation of the copying machine having the arrangement described above will be described with reference to the block diagram in FIG. 6.

A main processor 120 receives signals from the operation panel 6 having the copy key 100 and the like and signals from the other switches and the detector 121 through an input interface circuit 119, and controls a display section 123 having the displays 103 and 106, and the indicators 110, 114 and 116 by a display driver 122. The main processor 120 thus controls the entire copy operation. The main processor 120 comprises a microcomputer and its peripheral circuits and is operated in accordance with a program stored in an internal memory (ROM). The main processor 120 thus provides various control operations.

Different control signals from the main processor 120 are supplied through a driver 124 to a heat roller control circuit 125, a lamp regulator 126, a paper feed solenoid 127, a blade solenoid 128, the discharge lamp 32 and a high-voltage transformer 129.

The heat roller control circuit 125 controls the energizing of the heat roller 27 to keep the roller 27 at a temperature for fusing the toner. The lamp regulator 126 controls the energizing of the exposure lamp 7. The paper feed solenoid 127 causes the shaft 20S to rotate in increments of half a revolution. When the blade solenoid 128 is energized, it causes a blade in the cleaner 31 to abut against the photoconductive drum 16. The high-voltage transformer 129 supplies a high voltage to the chargers 14, 23 and 24.

The main processor 120 is connected to a motor driver 136. The motor driver 136 comprises a processor for controlling the operation of the motors. The motor driver 124 controls the respective motors in response to control signals from the main processor 120 and detects the operating states of the respective motors. Detection signals from the motor driver 124 are fetched by the main processor 120. The motor driver 136 controls scan system motors 137 such as pulse motors for image scanning, process system motors 138 such as pulse motors for driving the peripheral units (e.g., convey system) of the copy process and a brushless motor, an aligning roller motor 139 for driving the register rollers 22, a paper discharge roller motor 140 for driving the discharge rollers 30, and the convey roller motor 142 for driving the roller $41_2$. The motor driver 136 receives a detection signal from a sensor 143 for detecting rotation of these motors.

The control circuit of the document feeder 2 will be described hereinafter. A subprocessor 131 receives signals from a state detection section 132 including the switches 75, 76 and 77 and the detectors 78 and 80, and controls the entire document feed operation. The subprocessor 131 comprises a microcomputer which is operated in accordance with a program stored in an internal memory. Various control operations are provided for the various members.

Different control signals from the subprocessor 131 are supplied to the solenoids 59 and 69 and the display 79 through a driver 133. The main processor 120 is connected to the document feeder 2 through a bus 135 and the input interface circuit 119.

The subprocessor 131 generates a document feeder set signal ADF-SET, a document ready signal DCU-RDY, a jam signal ADF-JAM and a motor stop signal MOT-STP. These signals are supplied to the main processor 120. The signal ADF-SET is generated when the detector 78 detects that the convey portion 52 of the document feeder 2 is closed, so that the main processor 120 selects a program providing a control sequence including the document feeder 2. The signal DCU-RDY is generated when the detecting lever 72 and the microswitch 75 detect the document D on the tray 53. In response to this signal, the main processor 120 starts the transport and copying procedure of the document D in the document feeder 2. The signal ADF-JAM is generated when jamming occurs in the document feeder 2. For example, it is generated when the document D cannot be detected by the detecting lever 73 and the microswitch 76 within a predetermined period of time after the roller 56 is started, or when the document D cannot be detected by the detecting lever 74 and the microswitch 77 within a predetermined period of time after the microswitch 76 detects the document. The signal ADF-JAM is generated when the subprocessor 131 receives signals from the microswitches 75 and 76 and determines whether or not jamming occurs in the document feeder 2. The signal MOT-STP is a command signal which represents the operating state of the document feeder 2. The main processor 120 causes the copying machine to start in response to the command signal.

The main processor 120 generates a document set signal DCU-SET, a document insertion signal DCU-IN and a document discharge signal DCU-OUT. These signals are supplied to the subprocessor 131. The signal DCU-SET is a command signal for feeding the document D from the tray 53 to the rollers 56 and for discharging any documents left on the document table 5. The signal DCU-IN is a command signal for driving the rollers 56 and 57 and the conveyor belt 60 to feed the document D to the document table 5 and for discharging any documents D left on the document table 5. The signal DCU-OUT is a command signal for discharging the documents from the document table 5 to the tray 3. The timings of these signals are described as follows. The signal DCU-SET is generated to withdraw the stopper 54, so that the documents D are fed to the rollers 56 all at once. The signal DCU-IN is generated for every document while the signal DCU-RDY is being generated. As a result, the documents D are placed on the document table 5. When the signal DCU-RDY is not generated, the signal DCU-OUT is generated to discharge the final document D. When the signal ADF-JAM is generated while the signal ADF-SET is not generated or when an abnormality occurs in the copying machine, the copying operation is interrupted. When the cause of the copying interruption is eliminated and the preset number of sheets is not completely copied, the signal DCU-SET is generated. Thereafter, the signal DCU-IN is repeatedly generated.

Figure 7:
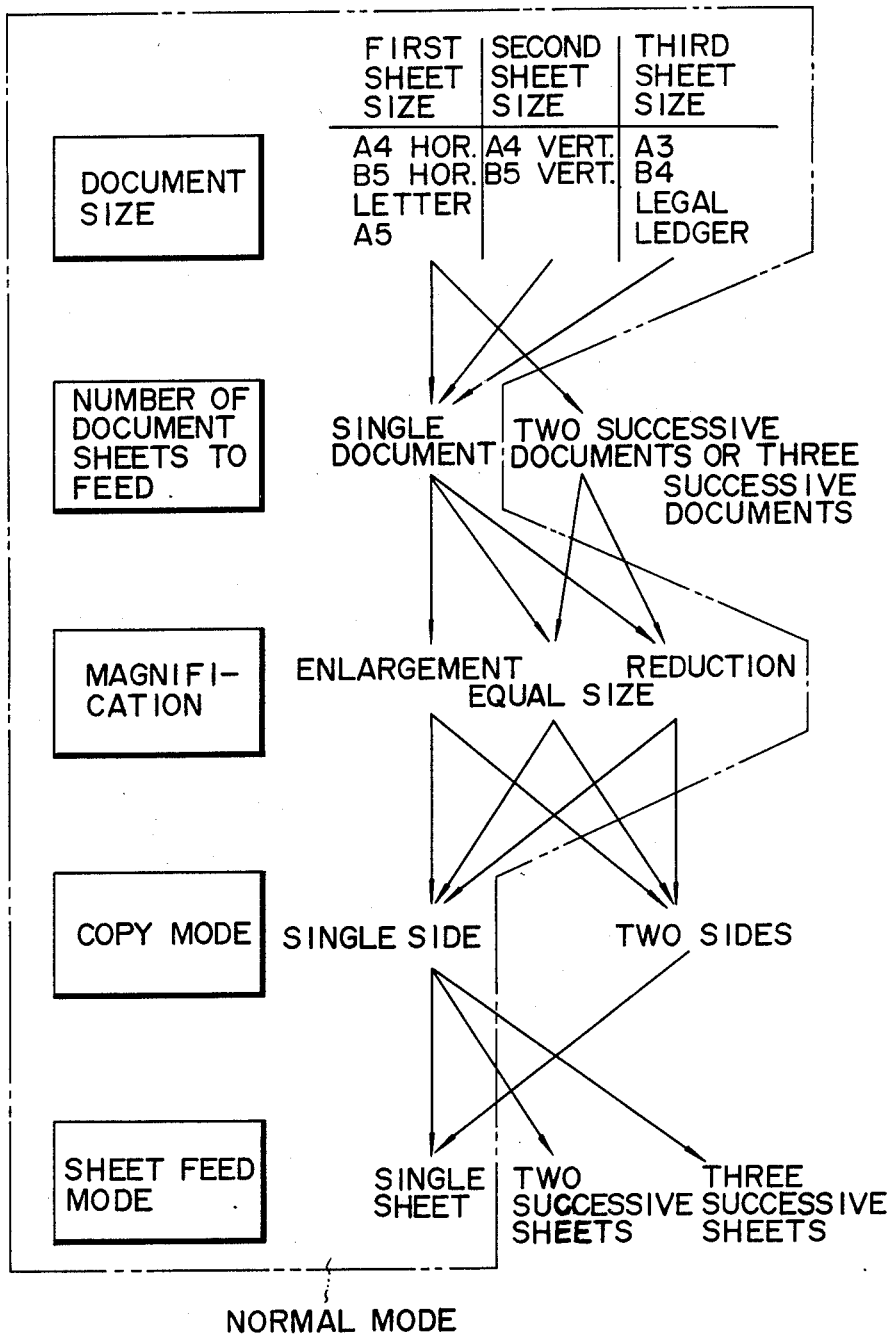
FIG. 7 is a diagram for explaining the operation of a main processor.

The main processor 120 detects the document size and the number of documents in accordance with signals from the document size input key 105 and the document feed number selection key 113. The main processor 120 then detects a magnification in accordance with a signal from the magnification key 112 and a copy mode (i.e., single side copy mode or two-side copy mode) in accordance with a signal from the selection key 109. In addition, the main processor 120 detects a copying density in accordance with a signal from the density selection key 111. The main processor 120 drives the mirrors 8, 9 and 10 and the lens block 11 in accordance with the detection results and controls the convey portion 52 such that one sheet is fed or two successive sheets are continuously fed. When the signal from the copy key 100 is received by the main processor 120 while the signal from the document feed number selection key 113 is not received, the main processor 120 detects that a single document was fed to the document feeder and executes a normal document feeding. When the main processor 120 receives the signals from the selection key 109, the density selection key 111 and the magnification key 112, the main processor 120 judges a single side copy mode and executes a normal paper feed control. The relationship between the sheet feeding modes and the copying conditions such as the document size, the document feed number, the magnification and the copying state is illustrated in FIG. 7.

Figure 10:
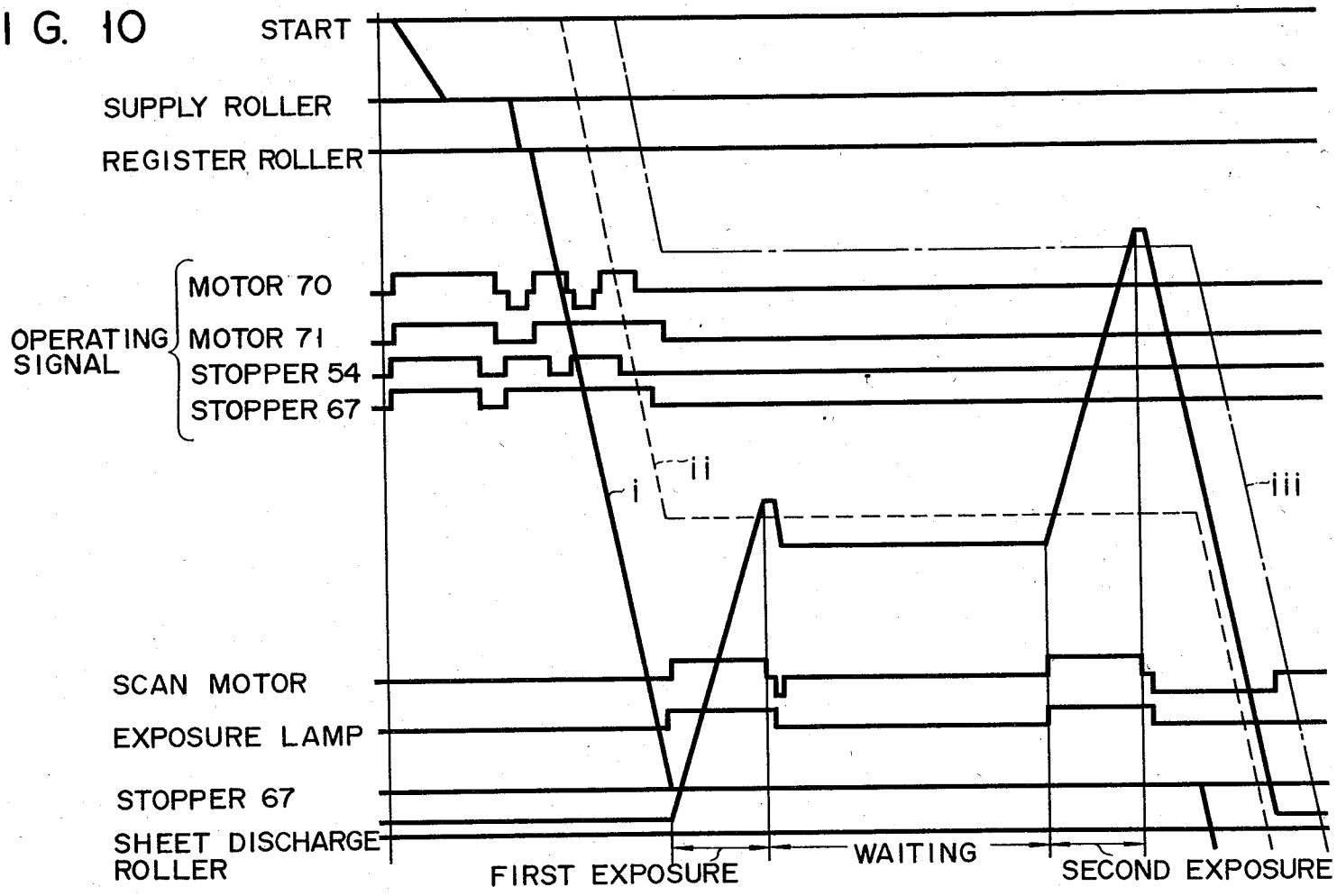
FIGS. 10 to 13 are respectively timing charts for explaining the operations of the copying machine.
Figure 11:
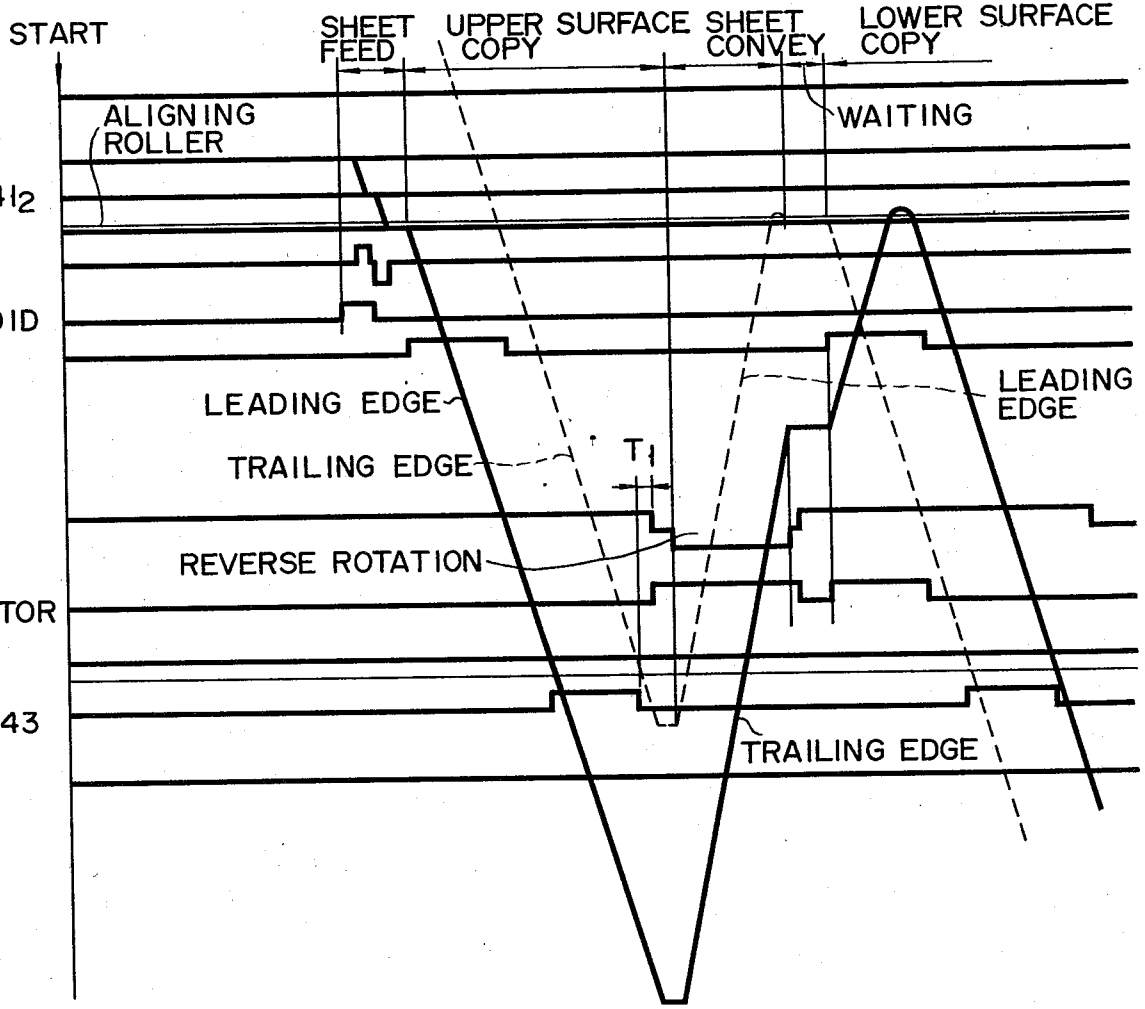

The operation will be described in more detail with reference to FIGS. 8 and 9 wherein the document size is "A4", the document feed mode represents continuous feeding of two successive sheets, the magnification represents equal size, and the copying mode represents two-side copying. The operations of the copying machine will also be described with reference to the flow charts in FIGS. 10 and 11. FIG. 10 is a timing chart wherein the lines representing the movement of the document is superposed on the waveforms of the interface signal and the operating signals. FIG. 11 is a timing chart wherein the lines representing the movement of the sheet fed from the paper cassette 19 is superposed on the waveform of the operating signals. Referring to FIG. 10, i shows a leading edge of a first document, ii shows a trailing edge of the first document and a leading edge of a second document, and iii shows a trailing edge of the second document. Assume that a plurality of documents D are placed on the tray 53 at once. The detection lever 72 is urged to turn on the microswitch 75. The subprocessor 131 detects that the documents are present on the document tray and causes the indicator 79 to turn on. When the operator selects "A4" with the document size input key 105, the main processor 120 causes the segment 107 to indicate "A4". The main processor 120 compares the possible exposure area with the input conditions and detects that two-document feeding is possible. The main processor 120 supplies the two-document feeding control signal to the subprocessor 131. A distance required for separating two consecutively fed documents is "3/2×length of A4 size (210 mm)=315 mm". The rollers 56 are controlled to be rotated for 315 mm in response to the control signal. When the operator depresses the selection key 109, the main processor 120 detects that two-side copying is to be performed. When the operator depresses the copy key 100, the motor 70 is rotated to convey the document D under the control of the subprocessor 131. In this case, the odd or even number of documents is detected by the signals from the microswitch 77 which are counted by the subprocessor 131. If this count is kept unchanged at an odd number for a predetermined period of time, the subprocessor 131 detects jamming with the comparison result between a time counted after the document size input key 105 is pressed and the document travel time with the state wherein the microswitch 75 is off, indicating that the documents are not left on the document tray. With this detection, if the subprocessor 131 determines that the document is the final document, the reverse rotation of the discharge rollers 68 is stopped and the final document is discharged to the tray 3.

The document pickup and convey operations will be described in detail. Assume that the documents D are set in the document feeder 2, that the cover of the pickup portion 51 is closed, that the microswitch 80 is turned on, and that the convey portion 52 is closed and the microswitch 78 is turned on. The main processor 120 detects the document feed ready state. When the copy key 100 is depressed, the DCU-SET signal is generated from the main processor 120. In response to this signal, the subprocessor 131 sets the DF-BUSY signal at level "H". At the same time, the solenoids 59 and 69 are energized, and the motor 70 is rotated. The leading edge of the document D is released by the stopper 54 and is moved by the roller 55 to the position of the rollers 56. The subprocessor 131 simultaneously drives the motors 70 and 71, so that the belt 69 is driven. In this case, since the solenoid 69 is turned on, the stopper 67 is moved below the document table 5. When the document is present within the convey path, this document is discharged. The subprocessor 131 deenergizes the solenoids 59 and 69 after a sufficient period of time has elapsed to allow the document to be moved to the position of the rollers 56. In this state, the signal DF-BUSY from the subprocessor 131 goes low and is supplied to the main processor 120 so as to represent that the documents are completely set.

When the main processor 120 detects the signal DF-BUSY of low level, it generates the signal DCU-IN to start document feeding. The subprocessor 131 receives the document feed start command to energize the solenoids 59 and 69 again. Thereafter, the subprocessor 131 drives the motor 70 to separate the first document from the other documents. In a short period of time after the leading edge of the document has reached the register rollers 57, the motor 70 is stopped. The subprocessor 131 then drives the motors 71 and 70 to feed the document. The stopper 54 and the roller 55 are operated to push the trailing edge of the first document and to feed the leading edge of the second document to the position of the rollers 56. The solenoid 59 is deenergized before the trailing edge of the first document passes through the rollers 56. When the second document is separately fed, the stopper 54 is placed in the predetermined position. Before the trailing edge of the first document passes through the rollers 56 and the stopper 54 is placed in the predetermined position, the subprocessor 131 drives the motor 70 to change the rotational direction so as to feed the second document following the first document. The rollers 56 push the trailing edge of the first document, separate the second document from the remaining documents and start to feed the second document when the trailing edge of the first document passes through the rollers 56. When a sufficient period of time has elapsed during which the leading edge of the second document passes through the register rollers, the subprocessor 131 switches the rotational direction of the motor 70. Since the solenoid 59 is turned off and then turned on when the motor 70 is stopped, the roller 55 and the stopper 54 are operated to push the trailing edge of the second document and to feed the third document to the position of the rollers 56. Subsequently, the subprocessor 131 deenergizes the solenoid 59. When a sufficient period of time has elapsed during which the stopper 54 is placed in the predetermined position, as described above, the motor 70 is stopped. When the first document is conveyed and its leading edge reaches a position just before the stopper 67, the subprocessor 131 turns off the solenoid 69 to extend the stopper upward above the document table 5. The motor 70 is stopped when the leading edge of the first document has reached the stopper 67. According to the above operation, the two documents are set on the document table 5, and then can be optically scanned. The signal DF-BUSY goes low ("L") during document feeding, so that the main processor 120 detects the ready state of the copying machine.

Figure 8:
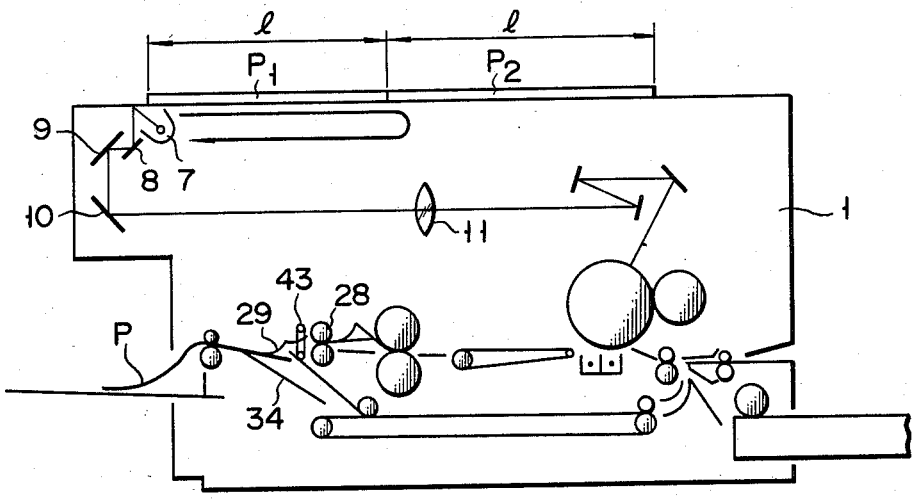
FIGS. 8 and 9 are respectively schematic sectional views for explaining the operation of the sheet material transporting apparatus.

When the above-mentioned document feeding is completed, the main processor 120 causes the exposure lamp 7 to scan from the first exposure start point on the left-hand side in FIG. 8 to the second exposure start point. In other words, the first document D is exposed and scanned. Light reflected by the first document D reaches the mirror 12 by the mirrors 8, 9 and 10 and the lens block 11. The light is reflected by the mirror 12 and is guided to the photoconductive drum 16 by the mirrors 13 and 14. A latent image of the first document D is formed on the photoconductive surface of the photoconductive drum 16, and this latent image is developed by the developing unit 18 upon rotation of the photoconductive drum 16. In this case, the sheet P is picked up from the paper cassette 19 and is conveyed to a portion between the photoconductive drum 16 and the transfer charger 23 by the register rollers 22. The toner image on the photoconductive drum 16 is then transferred by the transfer charger 23 to the sheet P. The sheet P is then peeled off by the peeling-off charger 24 from the surface of the photoconductive drum 16. The sheet P is conveyed by the conveyor belt 25 to the heat rollers 27, and the transferred toner image is fused thereby. The sheet P is then guided to the discharge rollers 30 along the convey path 29 by means of the discharge rollers 28. The detector 43 detects the passing of the sheet P. The discharge rollers 28 send the sheet to the convey path 29 for a predetermined period of time from the edge detection. When the predetermined period of time has elapsed after the trailing edge of the sheet P is detected by the detector 43, i.e., when the trailing edge of the sheet P has reached the branched point A' between the convey paths 29 and 34, the main processor 120 causes the discharge rollers 30 to rotate in the reverse direction. As the result, the trailing edge of the sheet P passes out of the convey path 29 and the sheet P is then directed to the path 34 by a projection **29*b* of the recessed guide 29*a* in the convey path 34 and the elastic force of the sheet P. In this case, the discharge rollers 30 are temporarily stopped and the leading edge of the sheet P is exposed outside the housing 1, so that the operator can visually check the image. The discharge rollers 30 are rotated to guide the sheet P in the convey path 34 again. The sheet P is clamped between the conveyor belts 36 and 37 and is conveyed. The sheet P fed from the conveyor belts 36 and 37 is conveyed in the inversion path 38. The inverted sheet P is then conveyed by the register rollers 22**.

Figure 9:
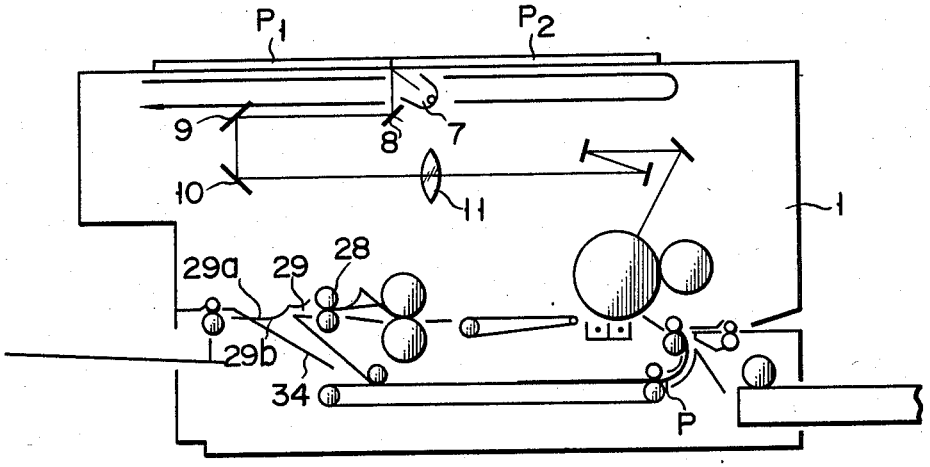

The main processor 120 causes the exposure lamp 7 to move from the first exposure start position at the left-hand side in FIG. 9 to the second exposure start point, and then to the second exposure end point, thereby exposing the second document D. Light reflected by the second document D reaches the mirror 12 by the mirrors 8, 9 and 10 and the lens block 11. The light is reflected by the mirror 12 and is guided to the photoconductive drum 16 by the mirrors 13 and 14. A latent image of the second document D is formed on the photoconductive surface of the photoconductive drum 16, and this latent image is developed by the developing unit 18 upon rotation of the photoconductive drum 16. The sheet P is picked up from the inversion path 38 and is conveyed to a portion between the photoconductive drum 16 and the transfer charger 23 through the register rollers 22. The toner image on the photoconductive drum 16 is then transferred by the transfer charger 23 to the sheet P. The sheet P is then peeled off by the peeling-off charger 24 from the surface of the photoconductive drum 16. The sheet P is conveyed by the conveyor belt 25 to the heat rollers 27, and the transferred image is fused thereby. The sheet P is then guided to the discharge rollers 30 along the convey path 29 by means of the discharge rollers 28. The sheet P is then discharged onto the tray 4. Thus, two-side copying continues for a preset copy number.

When scanning of the document is completed and the microswitch 75 is kept off and the signal DCU-RDY is set at level "H" at the timing when the next document is set on the document table 5, the main processor 120 generates the signal DCU-OUT. The subprocessor 131 receives the signal DCU-OUT and sets the signal DF-BUSY at level "H". At the same time, the solenoid 69 is turned on. The motor 71 is driven for a period corresponding to a distance sufficient to discharge the document D, and is then turned off. Simultaneously, the solenoid 69 is turned off and the signal DF-BUSY is set at level "L". The signal DF-BUSY of low level is supplied to the main processor 120.

When a paper jam occurs during the copy cycles of the first and second documents, the exposure system is returned to the home position in response to the reset signal. The exposure lamp 7 is moved from the first exposure start point to repeat the copy process described above.

The copied sheet number is counted in accordance with the output from the detector 44, and this count is used to correct the remaining copy number when a jam occurs.

When a document is present on the tray 53 and the detecting lever 72 detects this document, the above operation is repeated.

Figure 12:
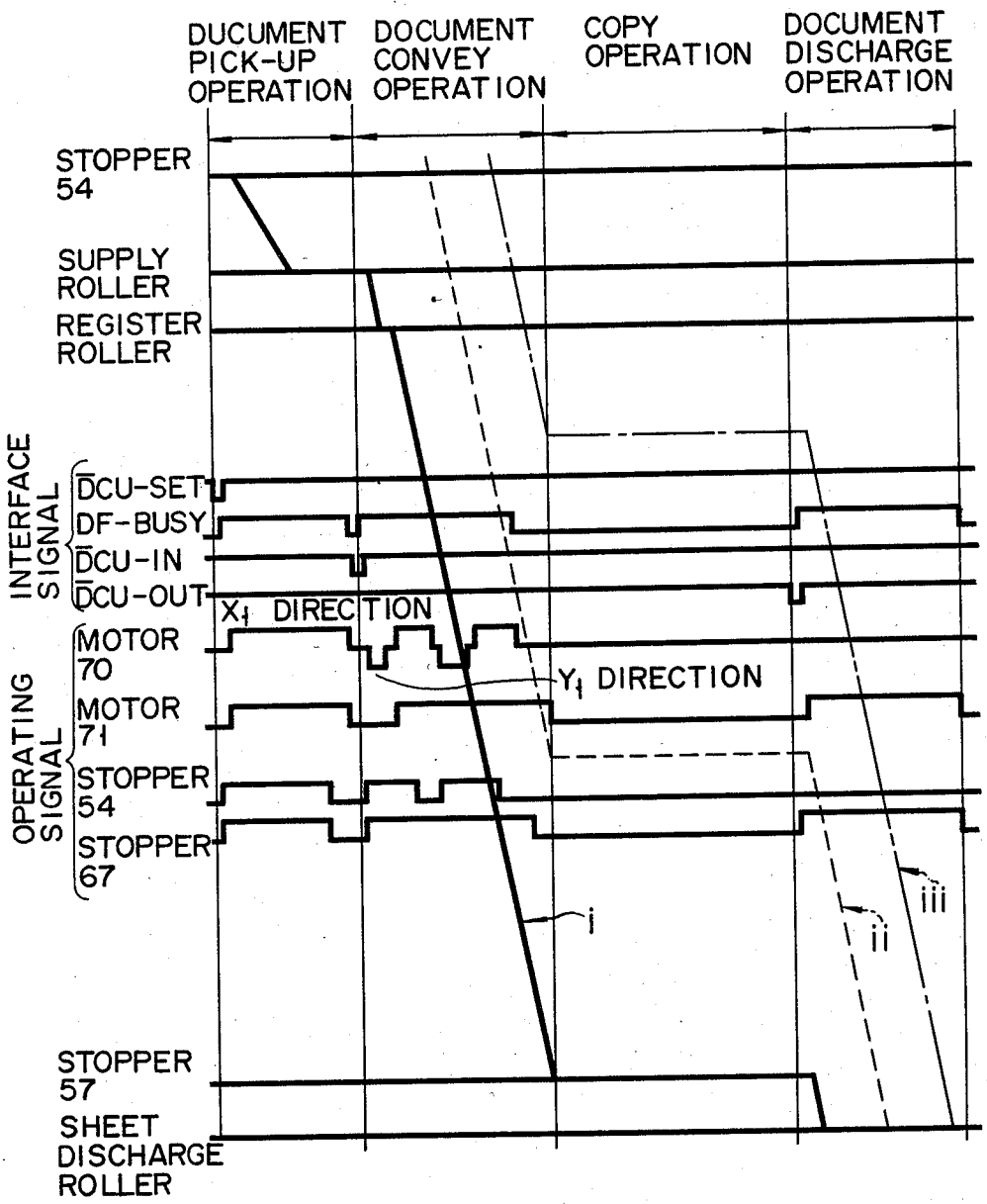
Figure 13:
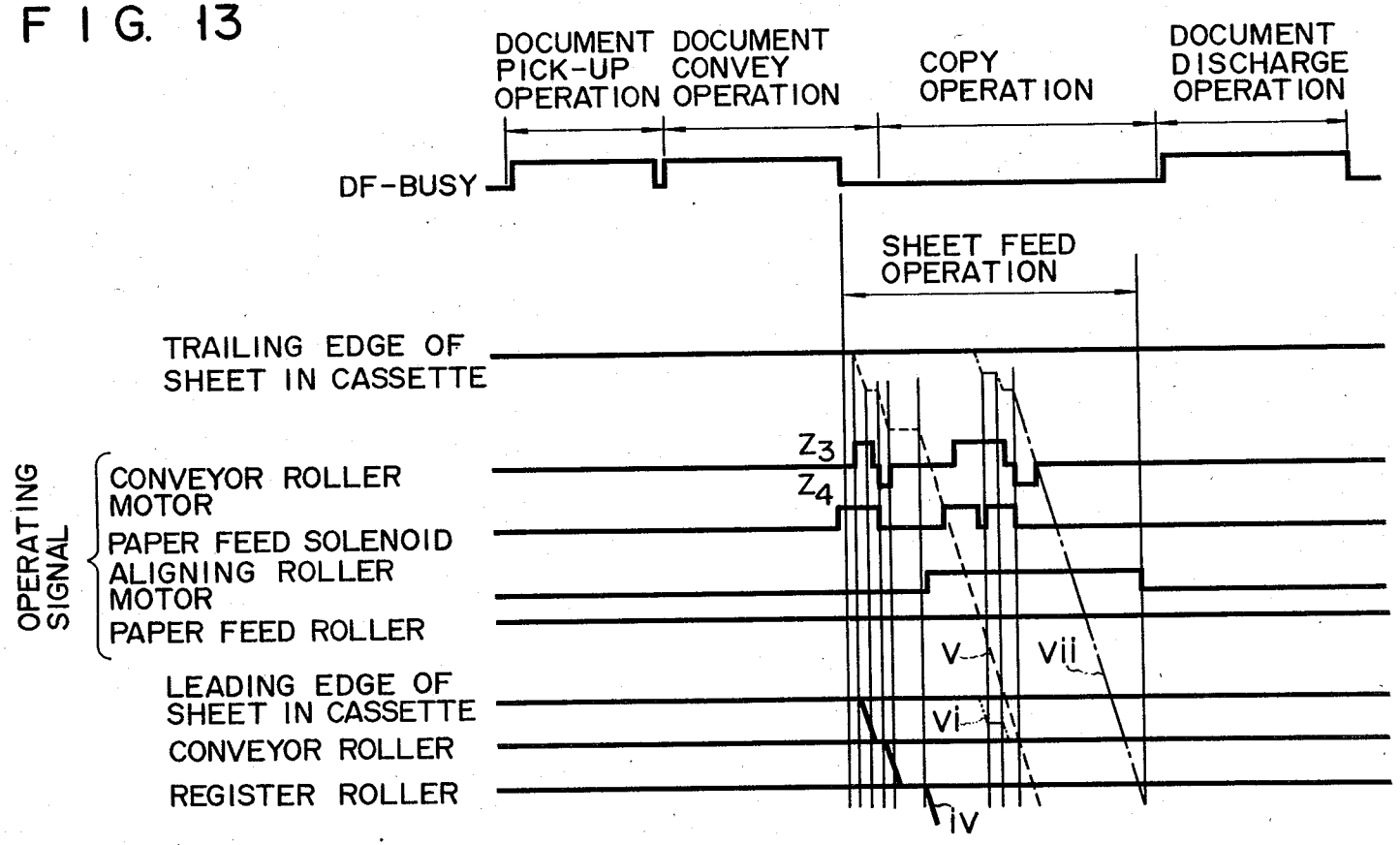

An operation will be described with reference to timing charts in FIGS. 12 and 13 wherein the document size is "A4", the document number represents two successive documents, the sheet feed number represents two successive sheets, the magnification represents the equal size, and the copy mode represents single side copying. FIG. 12 shows a timing chart wherein the lines representing the document movement is superposed on the waveforms of the interface and operating signals, while FIG. 13 shows a timing chart wherein the lines representing the movement of the sheet P supplied from the paper cassette 19 is superposed on the waveforms of the operating signals. Referring to FIG. 12, i shows the leading edge of the first document, ii is the trailing edge of the first document and the leading edge of the second document, and iii shows the trailing edge of the second document. Referring to FIG. 13, iv shows the leading edge of the first sheet P, v is the trailing edge of the first sheet P, vi shows the leading edge of the second sheet P, and vii shows the trailing edge of the second sheet P.

The document pickup and convey operation is the same as that in FIG. 10, and a detailed description thereof will be omitted. Only a pickup operation will be described wherein the main processor 120 receives the signal DF-BUSY from the subprocessor 131 to pick up the sheet from the paper cassette 19. The main processor 120 receives the signal DF-BUSY of low level from the subprocessor 131, and energizes the solenoid 127 to urge the sheets downward. In this state, the process system motors 138 are already started. The convey roller motor 142 is started to rotate the roller 20 in the Z3 direction. The sheet P is picked up by the roller 20. When the first sheet P is fed and its leading edge is clamped between the rollers $41_1$ and $41_2$, the motor 142 is rotated such that the roller $4_{11}$ is rotated in the Z4 direction. The leading edge of the sheet P is clamped between the register rollers 22, and at the same time the motor 142 is stopped. The sheet P is thus released. The copying machine waits under this condition, and the motor 139 is started at a timing when the exposure system matches with sheet feeding and the leading edge of the sheet P is aligned with the image on the photoconductive drum 16. Thus, the sheet P is conveyed again. When the trailing edge of the sheet P comes to a position immediately before the roller 20, the solenoid 127 is turned on and the sheet P is pressed downward. The motor 142 is rotated in the Z3 direction to push the trailing edge of the sheet P forward. When the trailing edge of the first sheet P passes below the roller 20, the second sheet P is fed overlapping the first sheet P. Since the leading edge of the second sheet P may reach the roller $41_2$ together with the first sheet P, the solenoid 127 is deenergized to allow consecutive feeding of the sheets. In this manner, the second sheet P reaches the rollers $41_1$ and $41_2$. Before the trailing edge of the first sheet P passes through the rollers $41_1$ and $41_2$, the roller 41 is rotated in the Z4 direction. Therefore, the trailing edge of the first sheet P is brought into contact with the leading edge of the second sheet P, and these sheets are conveyed. Thereafter, when the leading edge of the second sheet P is clamped between the register rollers 22, the motor 142 is turned off. The motor 139 is stopped when the trailing edge of the second sheet passes through the register rollers 22.

According to the present invention as has been described in detail, when the trailing edge of the sheet along the first convey path is located in a predetermined position, the convey direction thereof can be reversed irrespective of the size of the sheet, thereby providing a sheet material transporting apparatus for properly switching the convey direction of copying sheets.

What is claimed is:

1. A sheet material transporting apparatus comprising:

first conveyance means for conveying a sheet having a predetermined elastic force and an image on one surface thereof in a first direction along a first conveyance path, the image being formed by an image forming section;

second conveyance means for conveying the sheet passed via the first conveyance path in a second direction along a second conveyance path positioned under the first conveyance path and extending to said image forming section where an image is formed on the other surface of the sheet;

a discharge section for discharging the sheet conveyed via the first conveyance path;

trailing edge detecting means, arranged in the vicinity of a branched portion between the first and second conveyance paths, for detecting the trailing edge of the sheet;

a sheet guide section provided between said branched portion and said discharge section, said sheet guide section including a recessed guide member which causes said branched portion to communicate with said discharge section, and which has a projection extending downward; and means for sending the sheet in the first direction for a predetermined period of time from the time the trailing edge of the sheet is detected by said trailing detecting means, and for directing the trailing edge of the sheet, by the correlation of the elastic force of the sheet and said projection, to the second conveyance path.

2. An apparatus according to claim 1, wherein said sheet guide portion comprises a recessed guide member which causes the branched portion to communicate with the discharge portion and which has a recess extending downward, the trailing edge of the sheet conveyed from the first convey path being directed by an elastic force of the sheet in the recess to the second convey path.

3. An apparatus according to claim 1, wherein said discharge section has discharge roller means for discharging the sheet, said discharge roller means being driven in a reverse direction so as to feed the sheet toward the second convey path.

4. An apparatus according to claim 1, wherein said second convey means comprises first and second conveyor belts so as to clamp and convey the sheet.

5. An apparatus according to claim 1, wherein the second convey path has an inverted path for inverting the sheet having the image on said one surface thereof and guiding the sheet to the image-forming section.

* * * * *